US007264370B2

(12) United States Patent
Clanton

(10) Patent No.: US 7,264,370 B2
(45) Date of Patent: Sep. 4, 2007

(54) LIGHT EMITTING DIODE ROADWAY LIGHTING SYSTEM

(75) Inventor: Nancy E. Clanton, Lyons, CO (US)

(73) Assignee: Clanton Engineering, Inc., Boulder, CO (US)

( * ) Notice: Subject to any disclaimer, the term of this patent is extended or adjusted under 35 U.S.C. 154(b) by 75 days.

(21) Appl. No.: 11/190,732

(22) Filed: Jul. 27, 2005

(65) Prior Publication Data

US 2006/0028808 A1 Feb. 9, 2006

Related U.S. Application Data

(60) Provisional application No. 60/592,656, filed on Jul. 30, 2004.

(51) Int. Cl.
*F21S 8/00* (2006.01)

(52) U.S. Cl. ..... 362/152; 362/153; 340/908.1

(58) Field of Classification Search ..... 362/152, 362/153; 340/908.1
See application file for complete search history.

(56) References Cited

U.S. PATENT DOCUMENTS

| | | | | |
|---|---|---|---|---|
| 3,131,871 | A * | 5/1964 | Foulds | 362/146 |
| 5,453,916 | A | 9/1995 | Tennis et al. | |
| 5,887,856 | A * | 3/1999 | Everly, II | 256/1 |
| 6,354,714 | B1 | 3/2002 | Rhodes | |
| 6,676,331 | B1 | 1/2004 | Casale | |
| 6,916,103 | B2 * | 7/2005 | Currie et al. | 362/145 |
| 2002/0145878 | A1 * | 10/2002 | Venegas | 362/431 |

FOREIGN PATENT DOCUMENTS

| | | | |
|---|---|---|---|
| EP | 0 479 693 B1 | | 6/1996 |
| JP | 2000230221 | * | 2/2000 |

* cited by examiner

*Primary Examiner*—Renee Luebke
*Assistant Examiner*—Evan Dzierzynski
(74) *Attorney, Agent, or Firm*—Macheledt Bales & Heidmiller, LLP; Jennifer L. Bales

(57) ABSTRACT

A system for lighting roadways utilizes LED lighting systems recessed into roadside barriers. The LED lighting element includes a number of LEDs fixed in an elongated formation. The LED lighting element is inserted into the barrier's recessed area in a generally vertical orientation. This results in the LED lighting system generating a horizontal sheet of light along the barrier.

14 Claims, 5 Drawing Sheets

LIGHT EMITTING DIODE ROADWAY LIGHTING SYSTEM

This application claims the benefit of U.S. Provisional Patent Application Ser. No. 60/592,656, Filed Jul. 30, 2004.

BACKGROUND OF THE INVENTION

1. Field of the Invention

This invention relates to roadway lighting. In particular, this invention relates to highway barrier lighting systems utilizing Light Emitting Diodes (LEDs).

2. Description of Related Art

Conventional roadway lighting is accomplished with overhead light standards mounted to a structure (e.g. a crash barrier or other structure serving as a physical barrier). Conventional overhead luminaries are glary, and the light that is emitted is uncontrolled, resulting in light trespass. Light trespass is an issue when a viaduct or roadway passes over or near a populated area. Conventional overhead lighting systems provide relatively high light levels over a very large horizontal area including the shoulder. However, the edge or shoulder is not highlighted but rather visually blended into the roadway scene. The overhead and diffuse (multidirectional) nature of the conventional lighting does not enhance small target visibility. Small targets are visually lost under conventional roadway lighting.

In the field of roadway lighting, the desire to improve small target visibility has been frustrated by the use of conventional overhead lighting. Direct overhead illumination by unfocused (diffuse, propagating in all directions) light makes small objects/targets invisible. Previous unsuccessful attempts to address the issue of small target visibility include development of asymmetric overhead light sources.

A need remains in the art for an alternative strategy of lighting, which reduces light trespass into a populated or other light sensitive area, enhances small target visibility, and reduces energy consumption without compromising the safety of motorists/travelers.

SUMMARY

An object of the present invention is to provide roadway lighting systems which reduce light trespass, enhance small target visibility, and reduce energy consumption without compromising the safety of motorists/travelers. This object is accomplished using an LED system for providing lighting for roadways, as well as viaducts, pathways, etc. The LED system provides a strategy to mitigate light trespass and light pollution, and highlight roadway edges when motorist/traveler guidance is critical.

The present roadway lighting system provides guidance to travelers, defines the edges of the roadway, illuminates animals or vehicles stopped on the shoulder, indicates on-ramp and off-ramp locations, and enhances safety of merging traffic. The LED lighting system illuminates with unidirectional lighting and thereby eliminates the problem of small target visibility.

The LED system provides the necessary illumination to enhance motorist guidance (beam illumination) and highlight disabled vehicles (field illumination).

Additionally, the low energy use and long lamp life of LED systems reduces maintenance and operating costs.

Apparatus for lighting a roadway according to the present invention comprises an elongated barrier unit which is placed along the side of the roadway, generally parallel to the roadway. The barrier unit forms a recessed area in its roadway-facing surface. Within the recessed are of the barrier is installed an LED lighting element having a plurality of LEDs fixed in an elongated formation, oriented in a generally vertical orientation. This results in the LED lighting element providing an approximately horizontal sheet of light along the barrier.

The barrier might be, for example, a continuous cast-in-place barrier, a discrete crash barrier, a snow fence, a tunnel wall, a guard rail, or a bollard.

The roadway could be, for example, a viaduct, a highway, an on-ramp or off-ramp, or the like.

The LED lighting element can be powered in a number of ways, including via a generator, a battery, a fuel cell, a photovoltaic system, or an electrical power supply.

DETAILED DESCRIPTION OF THE PREFERRED EMBODIMENTS

Historically, roadways and highways are lighted using luminaries on tall poles located on the edge of the pavement. This LED system provides an alternative to tall poles by providing vertical or near vertical sheet illuminance on the shoulder, thus increasing small target visibility and highlighting any animals motorists stopped on the shoulder. Since the described LED luminaire lights the vertical or near vertical sides of the barrier, the outer edge of the road is highlighted and delineated, providing excellent guidance especially during inclement weather conditions.

Low power consumption, minimal light trespass on adjacent properties, and minimal light pollution, especially in non-urban areas, makes this an ideal lighting system for roadways and highways with continuous barriers, construction barriers or rail structures.

Figure 1:
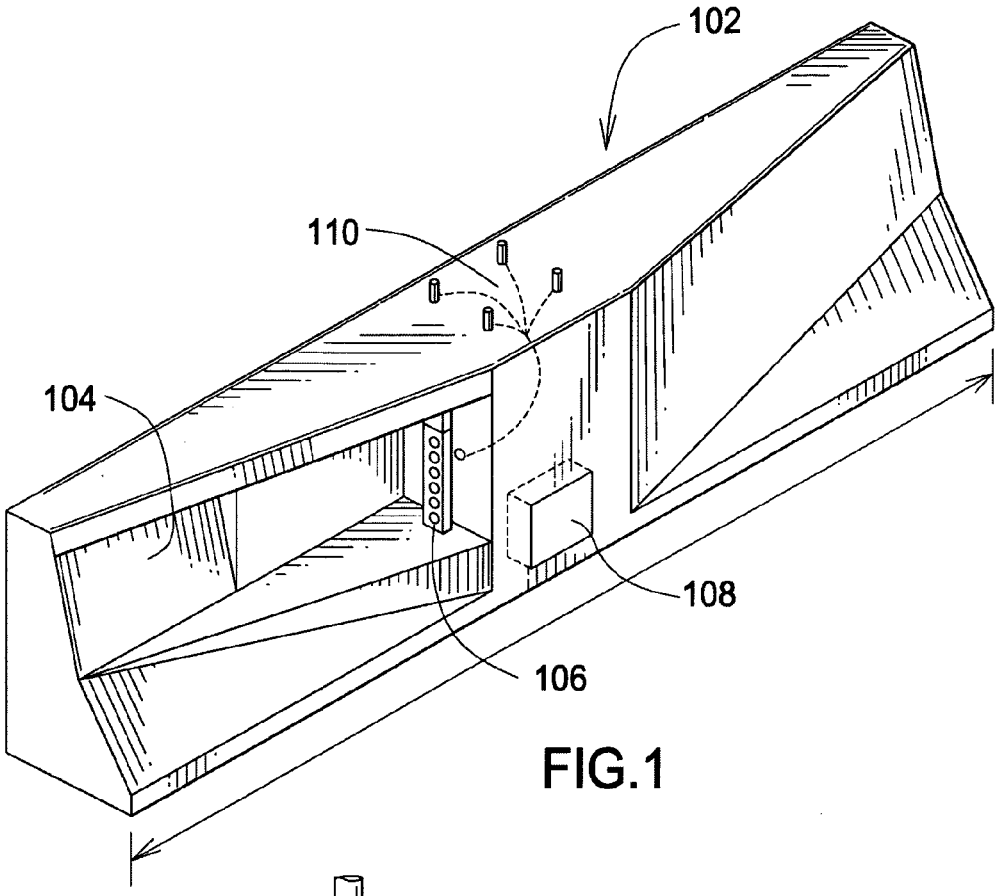
FIG. 1 is an isometric drawing showing a cast-in-place roadside barrier with a recessed LED lighting system according to the present invention.
Figure 2:
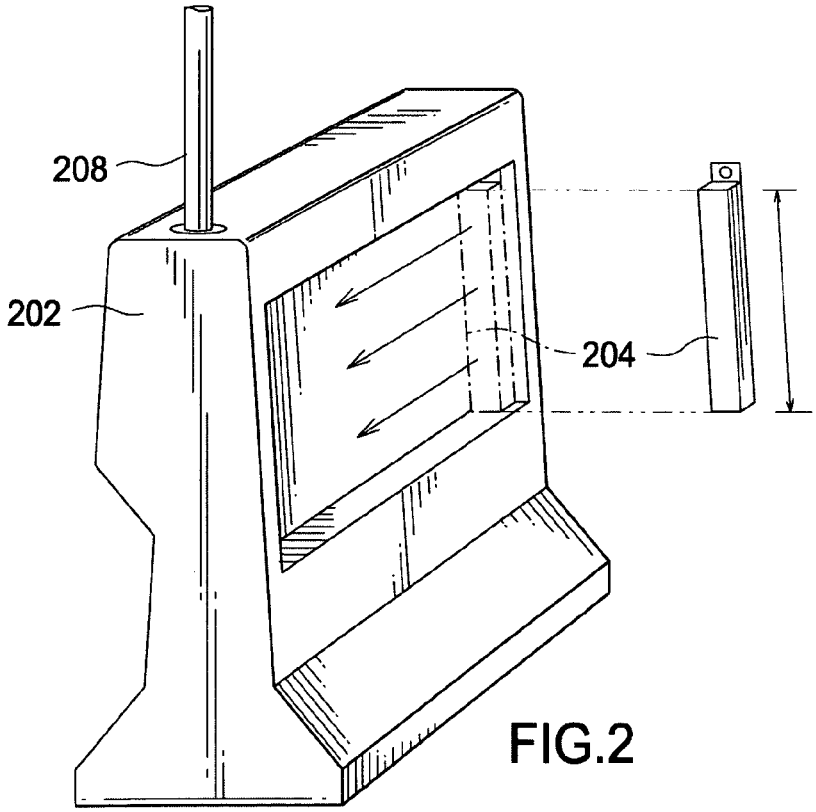
FIG. 2 is an isometric drawing showing a crash barrier having a recessed LED lighting system according to the present invention.
Figure 3:
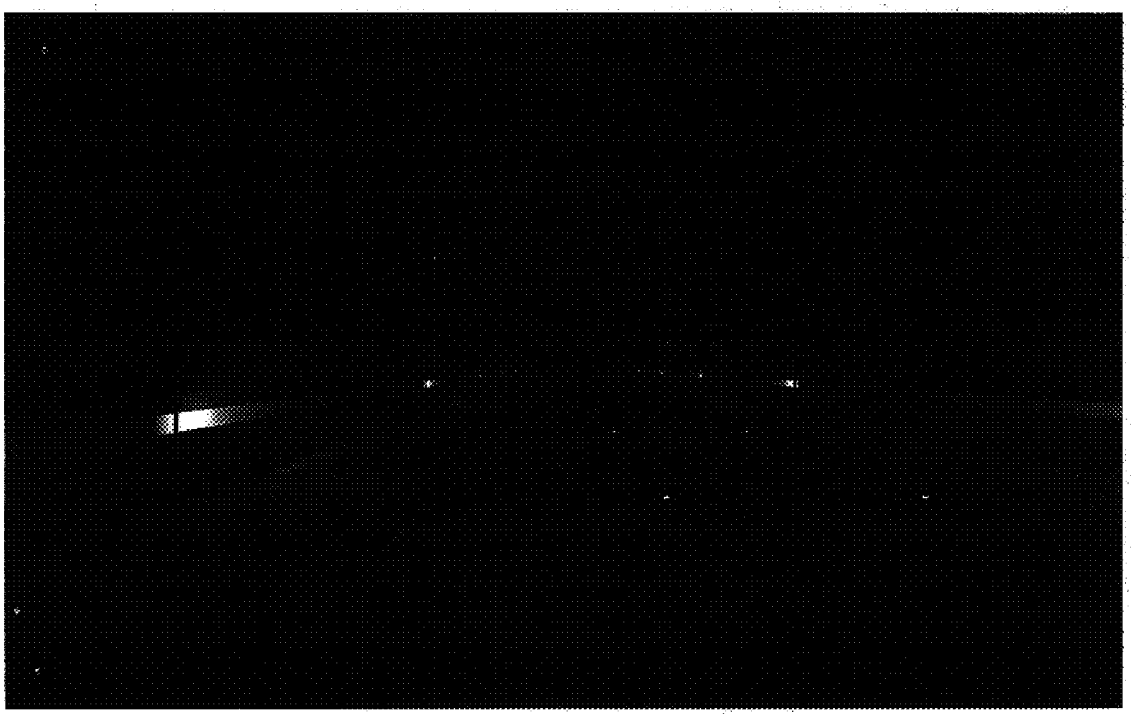
FIG. 3 is a photograph of a barrier lighting system according to the present invention, in use.
Figure 4:
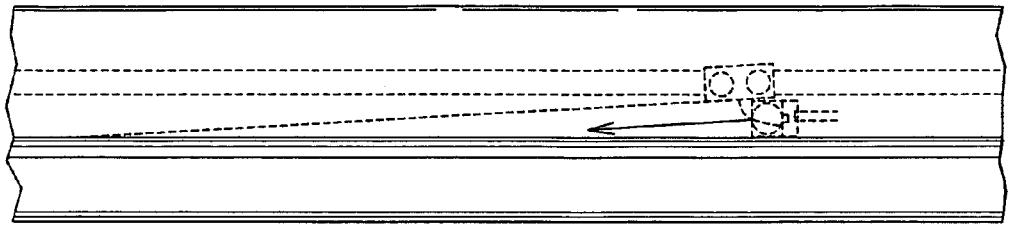
FIG.4 (PRIOR ART)
FIGS. 4 through 6 (prior art) show electrical and lighting details for conventional roadway lighting systems, called luminaires.
Figure 5:
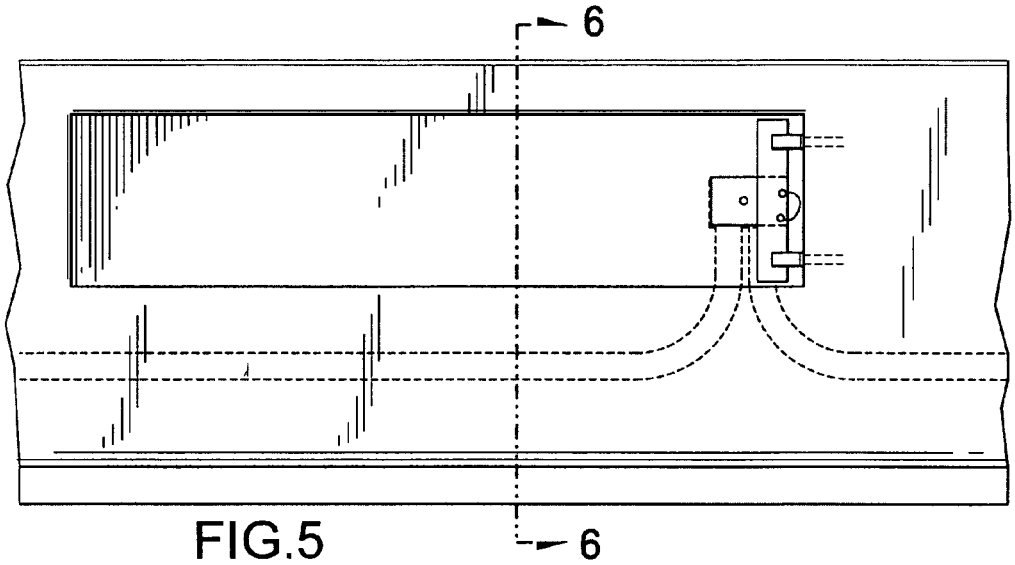
FIG.5 (PRIOR ART)
Figure 6:
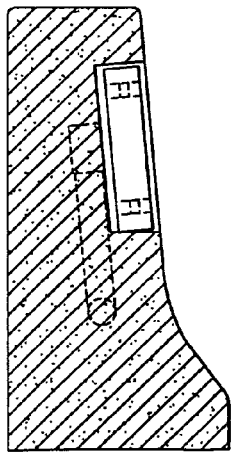
FIG.6 (PRIOR ART)
Figure 4A:
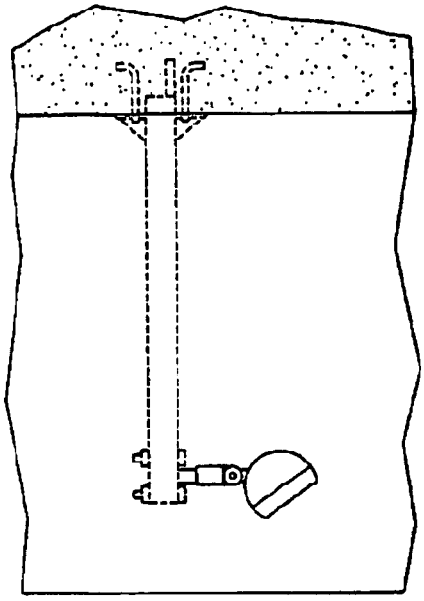
Figure 4B:
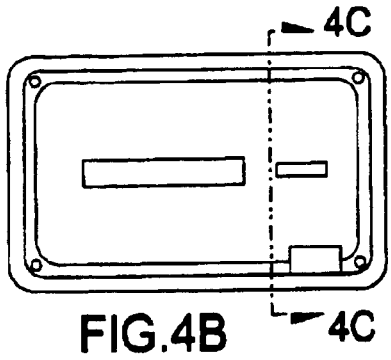
Figure 4C:
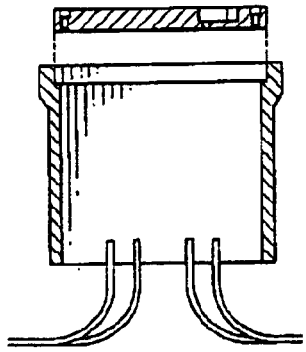
Figure 4D:
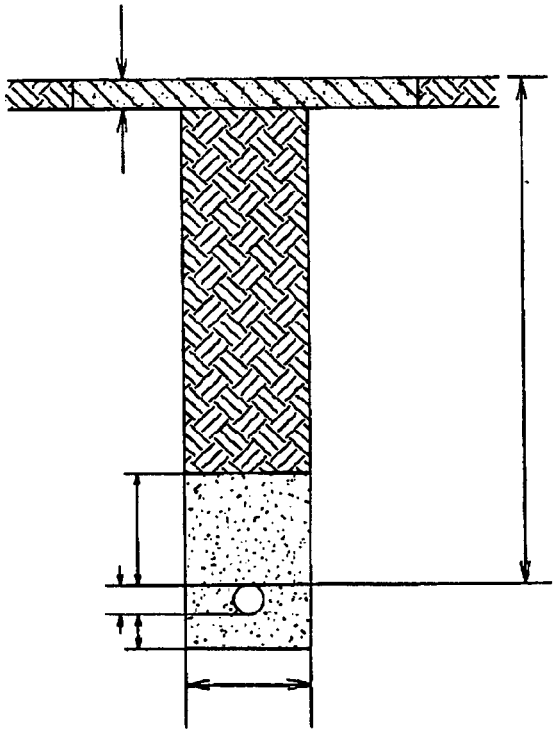
Figure 4E:
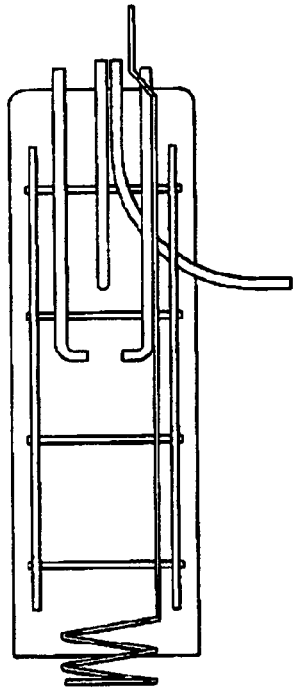
Figure 4F:
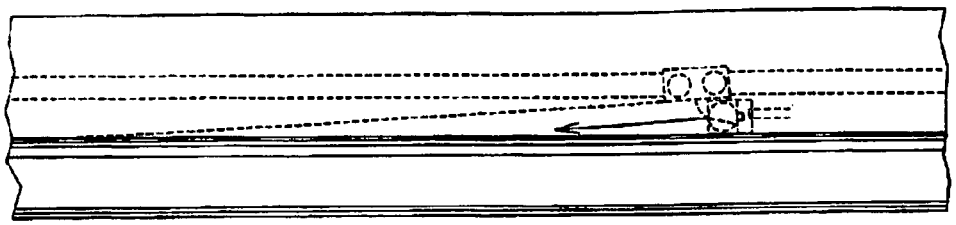
Figure 4G:
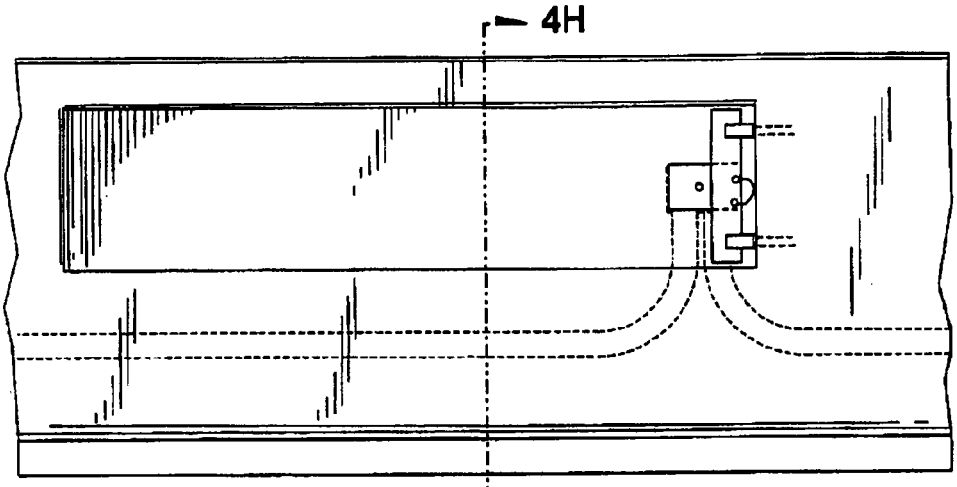
Figure 4H:
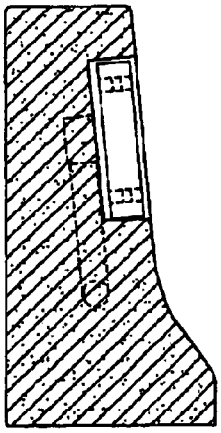

The strategy for lighting a viaduct, roadway, or pathway according to the present invention is shown in FIGS. 1-3. FIGS. 4 through 6 (prior art) show some typical roadway lighting systems. The present strategy of lighting reduces light trespass into a populated or other light sensitive area, enhances small target visibility, and reduces energy consumption without compromising the safety of motorists/travelers.

FIG. 1 is an isometric drawing showing a cast-in-place barrier 102 with a recessed LED lighting system 106 according to the present invention. LED lighting element 106 includes a plurality of LEDs aligned in an elongated configuration. Barrier 102 has a recessed area 104 into which lighting element 106 is placed. Power connection 110 provides power to lighting element 106. Junction box 108 is cast in place in barrier 102.

The LED luminaire 106 is mounted vertically and is recessed into the barrier 102. The aiming of the luminaire provides light grazing on the barrier surface.

The vertically or near vertically mounted LED luminaire 106 provides uni-directional light along the barrier face. Since the luminaire is integrated into the barrier 102, it does not cause a hazardous projection and does not compromise the crash function of the barrier.

The present roadside lighting system accentuates the roadway shoulder and barrier 102 by providing both beam and field contributions of the photometric distribution. The beam contribution of the LED system highlights obstacles such as the crash barrier 102. The field contribution of the LED system spills light onto the roadway shoulder or other target. Disabled motorists, for example, become more visible to oncoming traffic and very little light will escape (minimize light trespass and pollution) from the roadway structures.

The low energy use and long lamp life of LED systems 106 reduce maintenance and operating costs.

FIG. 2 is an isometric drawing showing a discrete crash barrier 202 having a recessed LED lighting system 206 according to the present invention. This barrier lighting system is similar to that shown in FIG. 1, in that barrier 202 includes a recessed area 204, into which LED element 206 is placed. LED element 206 is oriented vertically, and provides a horizontal sheet of light across barrier 202. In this example, barrier 202 is a Type 7 crash barrier, and includes a snow fence post 208.

FIG. 3 is a photograph of a barrier lighting system according to the present invention, in use on a roadway at night. A demonstration of the LED barrier illumination method was performed in December 2003. In co-operation with the Colorado Department of Transportation an unused ramp along the Denver metro stretch of Interstate 25 was fitted with temporarily mounted LED strips. A commercially available LED 24 inch strip luminaire was modified to include only white LEDs. In addition, only 12 inches (continuous length) of the strip was illuminated. The modified LED strips were mounted vertically on the barriers to provide horizontal lighting in the direction of travel. The demonstration barrier lighting was set at 80 feet; each unit cast light along the barrier for approximately 60 feet. The guidance and illumination achieved by the LED system are demonstrated in FIG. 3. The arrows indicate the light cast by several of the LED illumination units.

FIGS. 4 through 6 (prior art) show electrical and fighting details for several conventional roadway lighting systems, called luminaires, from the Colorado Department of Transportation. FIG. 4 is a plan view of a barrier luminaire. FIG. 5 is an elevation drawing of the barrier luminaire of FIGS. 4, and 6 is a section view of the barrier of FIGS. 4 and 5.

It will be appreciated by one versed in the art that there are many possible variations on these designs, but all are typified by LED lighting systems installed recessed areas of roadside barriers which provide a generally horizontal sheet of light across the barrier. Some known and anticipated variations are described below:

Variations include mounting the LED luminaire in a snow fence, guardrail or other roadside structure, a bollard, a bridge footing, or a tunnel wall. Barriers are made from a variety of geometries. Deployment of the LED lighting system is compatible with most conceivable barrier geometries.

The LED luminaries can be connected to electrical power supplies or operated from a portable power supply such as generator, fuel cell, or battery storage. In addition, alternative renewable supply such as photovoltaic assemblies can also be used as the power source.

What is claimed is:

1. Apparatus for lighting a roadway comprising:

an elongated barrier unit placed along a side of the roadway, generally parallel to the roadway, the barrier unit forming a recessed area in a roadway-facing surface;

an LED lighting element having a plurality of LEDs fixed in an elongated formation, the LED lighting element attached within the barrier recessed area in a generally vertical orientation; and means for powering the LED lighting element;

wherein the vertically oriented LED lighting element provides an approximately vertical sheet of light beginning at the element and extending horizontally along the barrier.

2. The apparatus of claim 1 wherein the barrier is a continuous cast-in-place barrier.

3. The apparatus of claim 1 wherein the barrier is a discrete crash barrier.

4. The apparatus of claim 1 wherein the barrier is a snow fence.

5. The apparatus of claim 1 wherein the barrier is a tunnel wall.

6. The apparatus of claim 1 wherein the barrier is a guard rail.

7. The apparatus of claim 1 wherein the roadway comprises a viaduct.

8. The apparatus of claim 1 wherein the roadway comprises a highway.

9. The apparatus of claim 1 wherein the roadway comprises an on-ramp or an off-ramp.

10. The apparatus of claim 1 wherein the means for powering comprises a generator.

11. The apparatus of claim 1 wherein the means for powering comprises a battery.

12. The apparatus of claim 1 wherein the means for powering comprises a fuel cell.

13. The apparatus of claim 1 wherein the means for powering comprises a photovoltaic system.

14. The apparatus of claim 1 wherein the means for powering comprises an electrical power supply.

* * * * *

UNITED STATES PATENT AND TRADEMARK OFFICE

CERTIFICATE OF CORRECTION

PATENT NO. : 7,264,370 B2
APPLICATION NO. : 11/190732
DATED : September 4, 2007
INVENTOR(S) : Nancy E. Clanton It is certified that error appears in the above-identified patent and that said Letters Patent is hereby corrected as shown below:

Column 1, line 5, delete “Filed” and insert --filed--.

Column 2, line 1, delete “are” and insert --area--.

Column 2, line 38, between “animals” and “motorists” insert --/--.

Column 3, line 48, delete “FIGS.” and insert --FIG.--.

Column 3, line 49, delete “4, and 6” and insert --4, and FIG. 6--.

Column 3, line 52, between “installed “ and “recessed” insert --into--.

Delete Drawings Sheet 4 of 5.

Delete Drawings Sheet 5 of 5.

Signed and Sealed this

Twenty-fifth Day of December, 2007

JON W. DUDAS
*Director of the United States Patent and Trademark Office*